US011313607B2

(12) United States Patent
Lee et al.

(10) Patent No.: US 11,313,607 B2
(45) Date of Patent: Apr. 26, 2022

(54) REFRIGERATOR

(71) Applicant: Samsung Electronics Co., Ltd, Suwon-si (KR)

(72) Inventors: Joo Yong Lee, Suwon-si (KR); Sun Gi Hong, Seoul (KR); Il Sung Bae, Seongnam-si (KR); Joo Hee Song, Yongin-si (KR); Byung Kwan Yang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 347 days.

(21) Appl. No.: 15/890,297

(22) Filed: Feb. 6, 2018

(65) Prior Publication Data

US 2018/0224188 A1 Aug. 9, 2018

(30) Foreign Application Priority Data

Feb. 6, 2017 (KR) ..... 10-2017-0016400

(51) Int. Cl.

| | |
|---|---|
| ***F25D 17/08*** | (2006.01) |
| ***F25D 17/04*** | (2006.01) |
| ***F25D 17/06*** | (2006.01) |
| *F25D 23/08* | (2006.01) |

(52) U.S. Cl.

CPC ..... *F25D 17/08* (2013.01); *F25D 17/045* (2013.01); *F25D 17/065* (2013.01); *F25D 23/087* (2013.01); *F25D 2317/067* (2013.01); *F25D 2317/0671* (2013.01)

(58) Field of Classification Search

CPC ..... F25D 17/08; F25D 14/045; F25D 17/065; F25D 2317/0671; F25D 2317/037

See application file for complete search history.

(56) References Cited

U.S. PATENT DOCUMENTS

| | | | | | |
|---|---|---|---|---|---|
| 3,206,946 | A | * | 9/1965 | Lindersmith | F25D 17/005 62/407 |
| 3,630,046 | A | * | 12/1971 | Boor | F25D 17/045 62/408 |
| 4,208,884 | A | * | 6/1980 | Popham | F25D 21/125 137/614.11 |
| 4,399,737 | A | * | 8/1983 | Severson | B60H 1/26 454/90 |
| 4,553,403 | A | * | 11/1985 | Taylor | F25D 17/08 34/225 |
| 4,553,584 | A | * | 11/1985 | Bloomquist | B60H 1/00014 165/263 |

(Continued)

FOREIGN PATENT DOCUMENTS

| | | | |
|---|---|---|---|
| JP | 2001099537 | A | 4/2001 |
| JP | 2008002732 | A | 1/2008 |

(Continued)

*Primary Examiner* — Larry L Furdge
*Assistant Examiner* — Alexis K Cox

(57) ABSTRACT

A refrigerator includes a duct module, wherein the duct modules include a front panel and a rear panel coupled to each other in the front-rear direction and forming a flow path, a plurality of flow path forming protrusions extending from a front surface of the front panel to form a flow path therebetween, and a sealing surface extending parallel to the rear surface of the front panel from front ends of the plurality of flow path forming protrusions and in surface contact with the rear surface of the front panel.

7 Claims, 9 Drawing Sheets

(56) References Cited

U.S. PATENT DOCUMENTS

| | | | | | |
|---|---|---|---|---|---|
| 5,027,615 | A * | 7/1991 | Wakatsuki | ..... | F25D 17/08 62/419 |
| 8,333,446 | B2 | 12/2012 | Kang | | |
| 2007/0101757 | A1* | 5/2007 | Park | ..... | F25D 17/062 62/407 |
| 2008/0256964 | A1* | 10/2008 | Lee | ..... | F25D 17/045 62/187 |

FOREIGN PATENT DOCUMENTS

| | | | | | |
|---|---|---|---|---|---|
| KR | 1996-0005027 | A | | 2/1996 | |
| KR | 2004063457 | A | * | 7/2004 | ..... F25D 17/08 |
| KR | 10-0759046 | B1 | | 9/2007 | |
| KR | 10-2008-0111164 | A | | 12/2008 | |
| KR | 10-2009-0051661 | A | | 5/2009 | |

* cited by examiner

REFRIGERATOR

CROSS-REFERENCE TO RELATED APPLICATION(S)

This application claims the benefit of Korean Patent Application No. 10-2017-0016400, filed on Feb. 6, 2017 in the Korean Intellectual Property Office, the disclosure of which is incorporated herein by reference.

TECHNICAL FIELD

Embodiments of the present disclosure relate to a refrigerator having a duct module distributing and supplying cold air to a storage compartment.

BACKGROUND

Generally, a refrigerator is an apparatus that is provided with refrigeration cycle components therein to supply cold air generated by an evaporator of the refrigeration cycle to a storage compartment such that products are stored in the storage compartment at a freezing temperature or at a refrigerating temperature.

The refrigerator includes an evaporator and a duct module for distributing and supplying cold air generated in the evaporator to the storage compartment.

The duct module includes a front panel and a front panel, wherein the front panel and the front panel are coupled to each other in the front-rear direction to form a flow path in the duct module.

SUMMARY

Therefore, it is an aspect of the present disclosure to provide a refrigerator having a duct module capable of preventing cold air leakage without a separate sealing member.

Additional aspects of the present disclosure will be set forth in part in the description which follows and, in part, will be obvious from the description, or may be learned by practice of the present disclosure.

In accordance with one aspect of the present disclosure to provide a refrigerator including a front panel, a front panel coupled to a rear side of the front panel to form a flow path with the front panel, a plurality of flow path forming protrusions configured to form a flow path by protruding from any one of a rear surface of the front panel and a front surface of the front panel, to the other of the rear surface of the front panel and the front surface of the front panel, and a sealing surface configured to be extended from the plurality of flow path forming protrusions to be in contact with the other of the rear surface of the front panel and the front surface of the front panel, in a surface contact manner.

The plurality of flow path forming protrusions may protrude from the front surface of the front panel to the front side, and the sealing surface is extended from the flow forming portion to be parallel with the rear surface of the front panel, to be in contact with the rear surface of the front panel in the surface contact manner.

The sealing surface may be extended to have a width, wherein the width of the sealing surface is equal to or greater than 25 mm.

The refrigerator may further include an sealing surface configured to protrude from the other of the rear surface of the front panel and the front surface of the front panel, to be in contact the flow forming portion in the surface contact manner.

The sealing surface and the sealing surface may be extended to have a width, wherein a sum of the width of the sealing surface and the width of the sealing surface is equal to or greater than 25 mm.

The refrigerator may further include a plurality of locking protrusions formed in a hook shape on an outer side of any one of the front panel and the front panel, and a plurality of locking grooves formed in a concave shape on an outer side of the other of the front panel and the front panel, to be engaged with the plurality of locking protrusions.

The plurality of flow path forming protrusions may include pair of flow path forming protrusions disposed separated in the left and right side, and a single flow path forming protrusion formed in approximately inverted V shape between the pair of flow path forming protrusions, and the sealing surface comprises a pair of sealing portions extended from the pair of the flow path forming protrusion to the outside, and a single sealing surface formed inside of the flow path forming protrusion that is formed in an approximately inverted V shape.

The refrigerator may further include a body provided with a storage compartment and a cooling compartment partitioned in front and rear by the duct module.

The storage compartment may include a refrigerating compartment and a freezing compartment provided in an upper portion and a lower portion of the body, wherein the duct module is installed in at least one of the refrigerating compartment and the freezing compartment.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
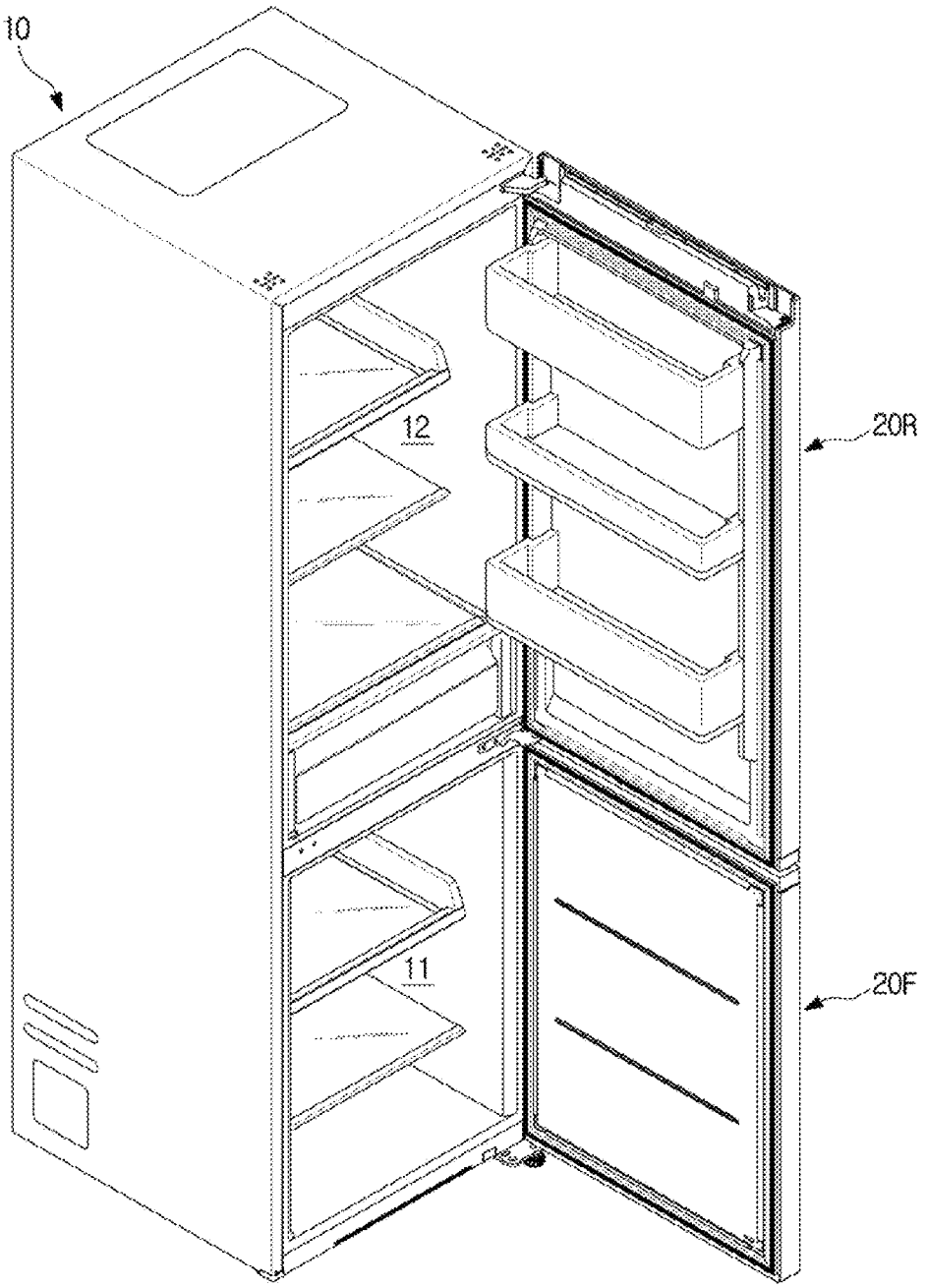
FIG. 1 is a perspective view illustrating a refrigerator according to an embodiment of the present disclosure.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a." "an" and "the" are intended to include the plural forms as well, unless the context clearly indicates otherwise. In this present disclosure, the terms "including". "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

In the following detailed description, the terms of "upper portion", "lower portion", "upper end", "lower end" and the like may be defined by the drawings, but the shape and the location of the component is not limited by the term.

The present disclosure will be described more fully hereinafter with reference to the accompanying drawings.

As illustrated in FIG. 1, according to an embodiment, a refrigerator includes a body 10 in which a refrigerating compartment 12 and a freezing compartment 11 are provided in an upper portion and a lower portion thereof, respectively, and a pair of doors 20R and 20F rotatably installed on a front surface of the body 10 to open and close the storage compartment 11 and 12 by rotating.

In addition, the refrigerator includes refrigeration cycle components such as a compressor 13, a condenser (not shown), an evaporator 14 (refer to FIG. 2), and an expansion valve (not shown).

Figure 2:
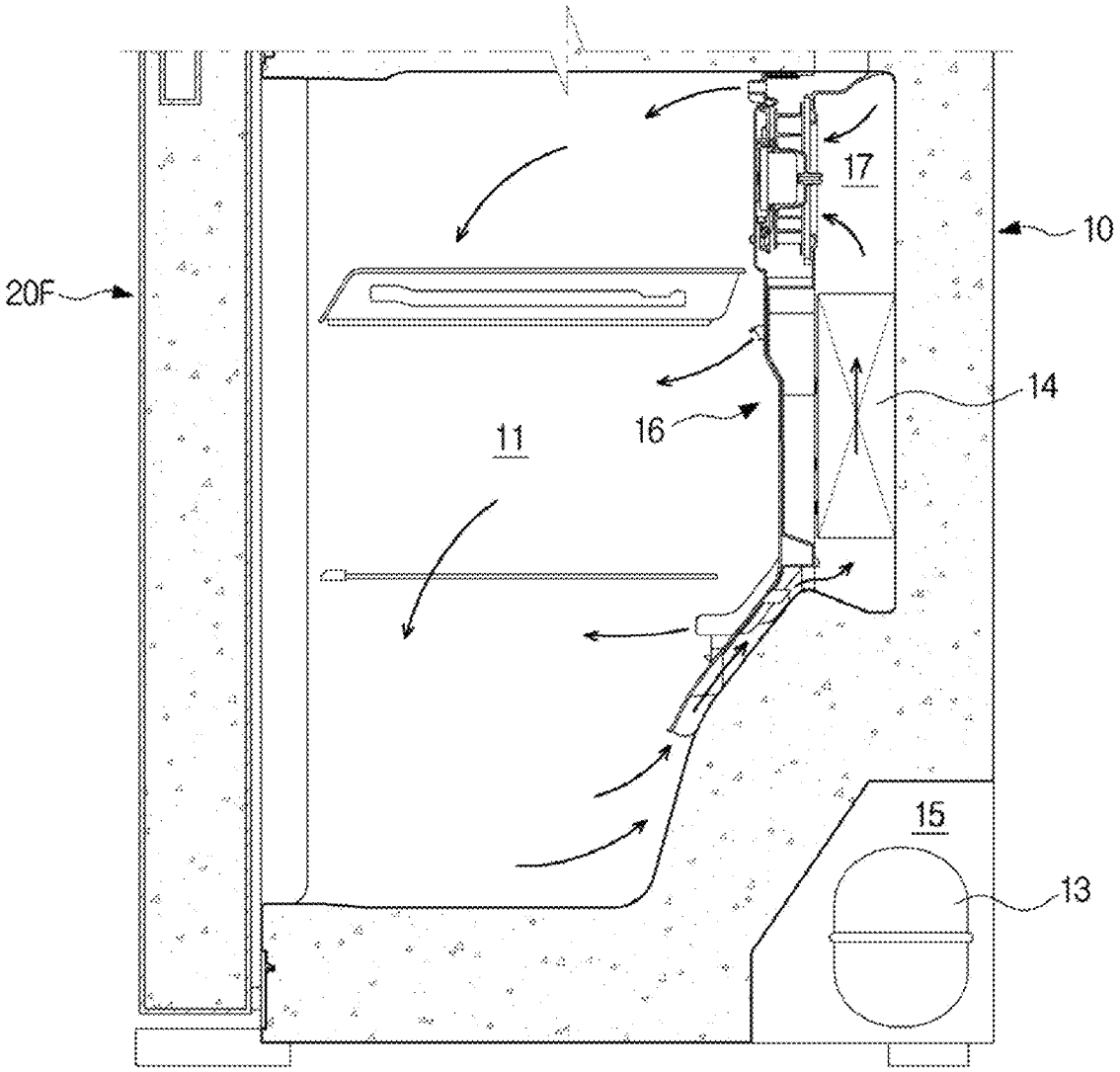
FIG. 2 is a bottom cross-sectional view illustrating the refrigerator according to the embodiment of the present disclosure.

The body 10 is formed in a vertically long rectangular housing shape, and the refrigerating compartment 12 is provided at an upper portion and the freezing compartment 11 is provided at a lower portion. As illustrated in FIG. 2, a machine room 15 is provided on the lower rear side of the body 10, wherein a compressor 13 and a condenser (not shown) are disposed in the machine room 15.

In the rear side of the storage compartments 11 and 12, a cooling compartment 17 in which the evaporator 14 is installed, and a duct module 16 configured to divide a space into the storage compartment 11 and 12 and the cooling compartment 17 in the front and rear direction may be disposed. That is, with respect to the duct module 16, a front portion may form the storage compartments 11 and 12, and a rear portion may form the cooling compartment 17.

The duct module 16 may be disposed in both of the freezing compartment 11 and the refrigerating compartment 12, but in this embodiment, a case in which the duct module 16 is installed in the freezing compartment 11 will be described.

The duct module 16 is configured to form a flow path 162*b* guiding air in the freezing compartment 11 to the cooling compartment 17 and at the same time, guiding cold air generated in the cooling compartment 17 to the freezing compartment 11, wherein the duct module 16 serves to uniformly distribute the cold air to the freezing compartment 11 as a whole.

Figure 3:
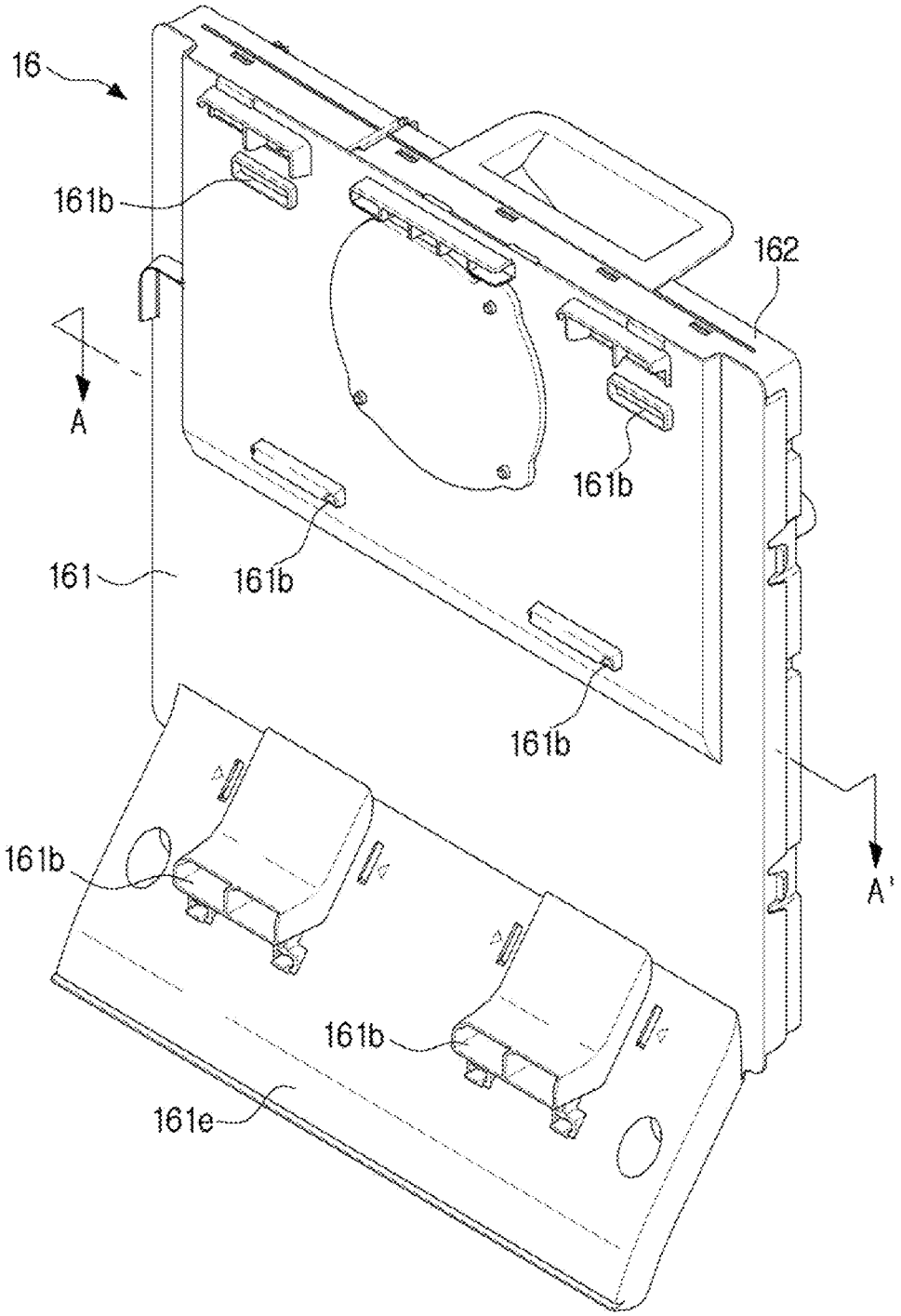
FIG. 3 is a perspective view illustrating a duct module applied to the refrigerator according to the embodiment of the present disclosure.
Figure 4:
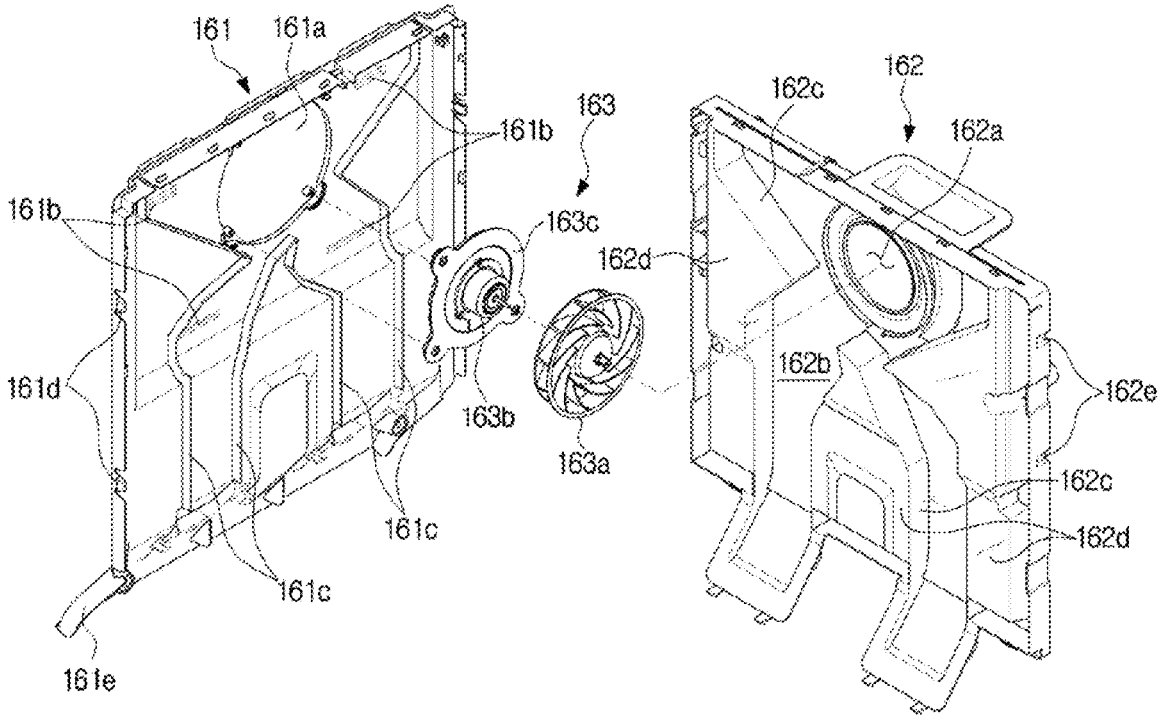
FIG. 4 is an exploded perspective view illustrating the duct module applied to the refrigerator according to the embodiment of the present disclosure.

As illustrated in FIGS. 3 and 4, the duct module 16 includes a front panel 161, a front panel 161 coupled to a rear side of the front panel 161 to form the flow path 162*b* together with the front panel 161, and a fan assembly 163 configured to circulate air.

The front panel 161 is disposed on the side of the freezing compartment 11, which is located on a front side, and forms a front side end portion of the duct module 16. The front surface of the front panel 161 faces the freezing compartment 11, and a rear surface thereof faces a front surface of the front panel 162.

The front panel 161 includes a mounting groove 161*a* and a guide portion 161*e*, wherein the mounting groove 161*a* is recessed at an upper portion of the rear surface of the front panel 161 facing the front panel 162, to allow the fan assembly 163 to be mounted thereon, and the guide portion 161*e* is provided in the lower portion of the front panel 161 to guide air, which is suctioned from the freezing compartment 11 to the cooling compartment 17. The guide portion 161*e* is extended to be inclined in the upper front side.

In addition, the front panel 161 includes a plurality of cold air outlets 161*b* configured to allow cold air to be distributed and supplied to the freezing compartment 11. In this embodiment, a pair of the cold air outlet 161*b* is disposed separated in the left and right side at the upper, middle, and lower portions of the front panel 161, respectively.

Therefore, the cold air is distributed and discharged to opposite sides of the upper, opposite sides of the middle and opposite sides of the lower portion of the freezing compartment 11 through the cold air outlet 161*b*, and thus the freezing compartment 11 may be uniformly cooled as a whole.

The front panel 161 includes a plurality of locking portions 161*d* is formed in a hook shape and configured to be engaged with a locking groove 162*e* of the front panel 162 described later.

The front panel 162 is disposed on the side of the cooling compartment 17, which is located on the rear side of the front panel 162, to form the rear side end portion of the duct module 16. The rear surface of the front panel 161 faces the cooling compartment 17, and the front surface thereof faces the front surface of the front panel 161.

Figure 5:
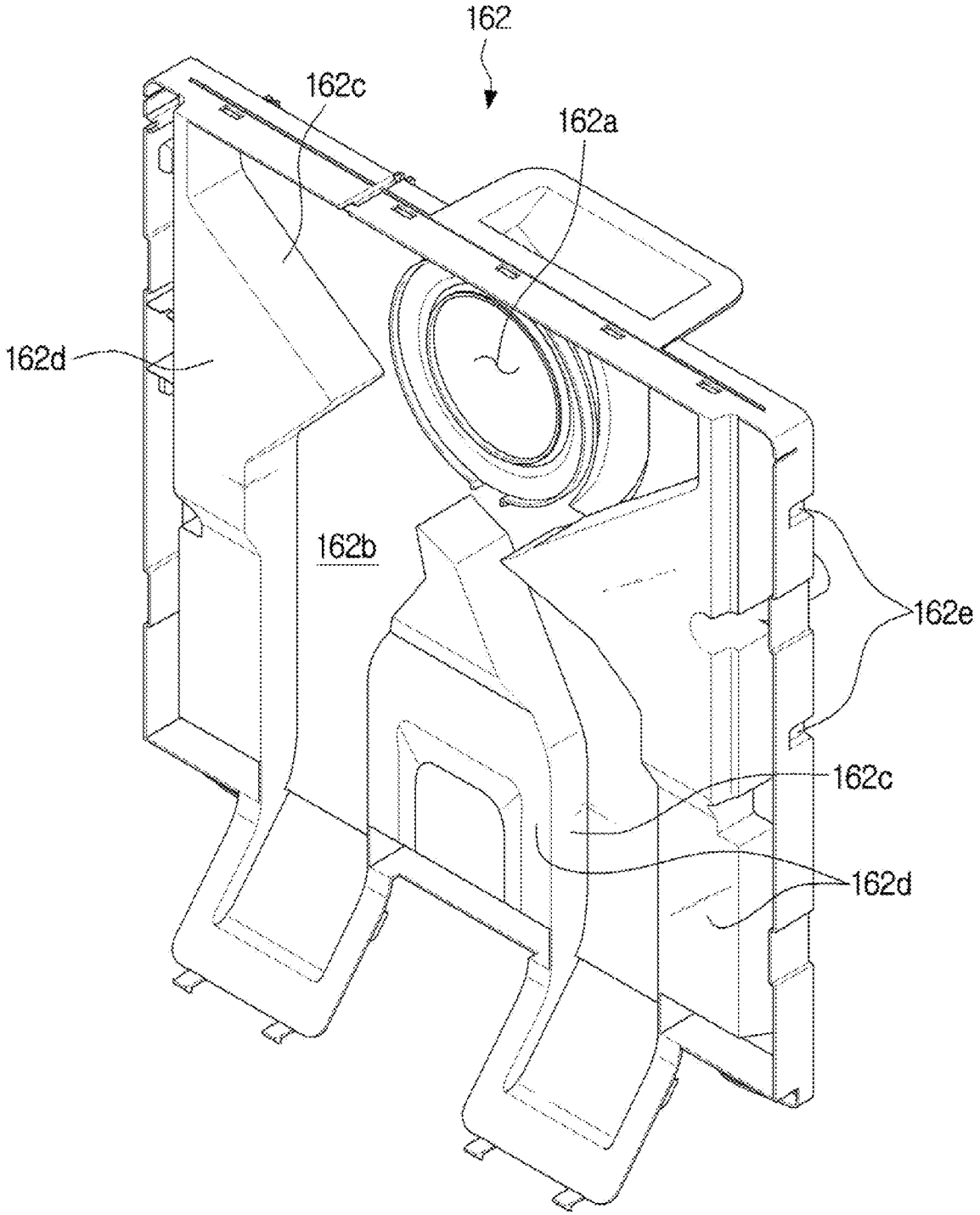
FIG. 5 is a perspective view illustrating a front panel in the refrigerator according to the embodiment of the present disclosure.

As illustrated in FIG. 5, the front panel 162 includes a cold air inlet 162*a* and a plurality of flow path forming protrusions 162*c*, wherein the cold air inlet 162*a* is provided in an upper portion of the front panel 162 to correspond to the fan assembly 163 so as to allow cold air of the cooling compartment 17 to be suctioned to the inside of the duct module 16, and the flow path forming protrusion 162*c* protrudes from the front surface of the front panel 162 to form the flow path 162*b*.

In this embodiment, the flow path forming protrusion 162*c* includes a pair of flow path forming protrusions 162*c* disposed separated in the left and right side, and a single flow path forming protrusion formed in approximately inverted V shape between the pair of flow path forming protrusions to divide the flow path 162*b* into two parts.

Accordingly, the flow path 162*b* is extended from the upper portion to the lower portion and divided into two parts so that cold air is guided and evenly distributed to two cold air outputs 161*b*, which are placed in the middle of the front panel 161, and two cold air outlet 161*b*, which are placed in the lower portion of the front panel 161.

The front panel 162 includes a sealing surface 162*d* extended from the front end of the flow path forming protrusion 162*c* placed on the side of the front panel 161, to be parallel with the rear surface of the front panel 161 so as to be in contact with the rear surface of the front panel 161 in the surface contact manner. The sealing surface 162*d* prevents the cold air passing through the flow path 162*b*, from leaking through a space between the front end of the flow path forming protrusion 162*c* and the rear surface of the front panel 161.

The sealing surface 162*d* includes a pair of sealing portions 162*d* extended from the pair of the flow path forming protrusion 162*c* to opposite lateral sides, and a single sealing surface 162*d* formed inside of the flow path forming protrusion 162*c* that is formed in an approximately inverted V shape. The sealing portions 162*d* have a width W1 (refer to FIG. 6) in the left and right direction and the width W1 of the sealing portions 162*d* is changed to correspond to the shape of the flow path 162*b*.

The front panel 162 includes the plurality of locking grooves 162*e* to which the locking portions 161*d* of the front panel 161 are locked. In this embodiment, the locking portions 161*d* protrude from four ends such as the upper, lower, left, and right ends of the front panel 161, to the rear side, and the locking grooves 162*e* are concave on the rear sides of four ends such as the upper, lower, left, and right of the front panel 162.

Figure 6:
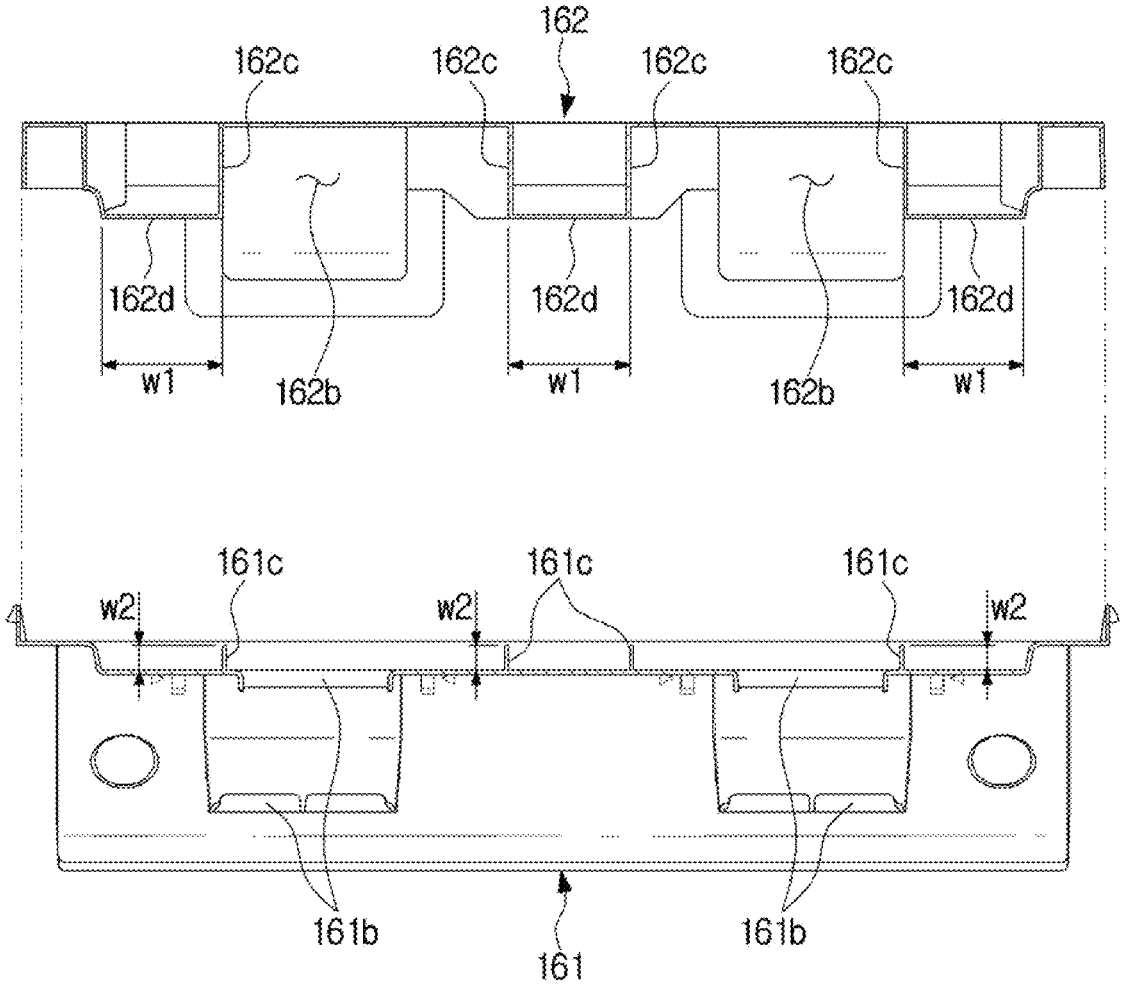
FIG. 6 is a cross-sectional view illustrating a coupling of a front panel and a front panel.
Figure 7:
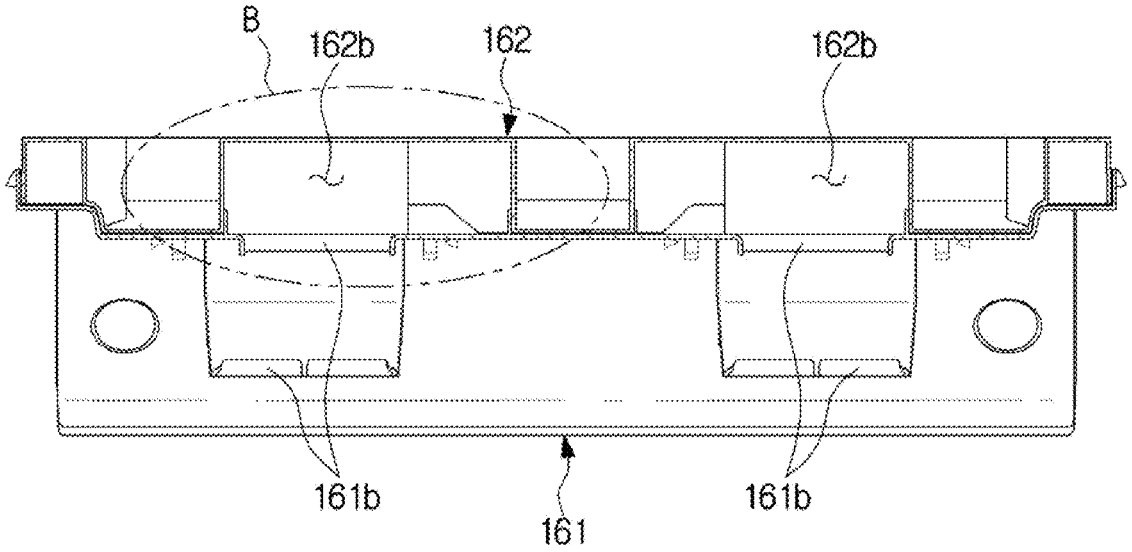
FIG. 7 is a cross-sectional view illustrating the duct module along a line A-A of FIG. 3.
Figure 9:
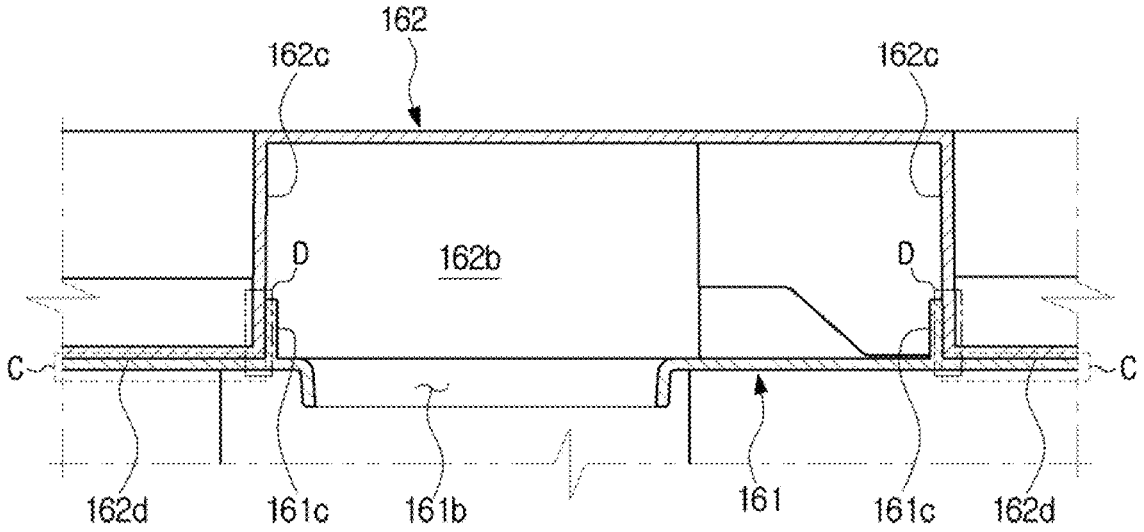
FIG. 9 is an enlarged view illustrating a portion B in FIG. 7.

In order that the locking portions 161*d* of the front panel 161 is engaged with the locking grooves 162*e* of the front panel 162, the front panel 161 and the front panel 162 are coupled to each other in the front and rear direction as illustrated in FIGS. 6 and 7 and thus the front surface of the sealing surface 162*d* and the rear surface of the front panel 161 are in contact with each other in a surface contact manner, as illustrated in a C part shown in FIG. 9.

Since it is very difficult for cold air to pass between the front surface of the sealing surface 162*d* and the rear surface of the front panel 161 which are in contact with each other in the surface contact manner, it may be possible to prevent the leakage of the cold air without a separate sealing member that is interposed between the front panel 161 and the front panel 162.

In order to more reliably prevent the leakage of the cold air, the front panel 161 includes an sealing surface 161*c* configured to protrude from the rear surface of the front panel 161 to have a shape corresponding to the flow path forming protrusion 162*c* so as to be in contact with the front panel 162 in the surface contact manner. In this time, the sealing surface 161*c* has a certain width W2 (refer to FIG. 6) in the front and rear direction.

Figure 8:
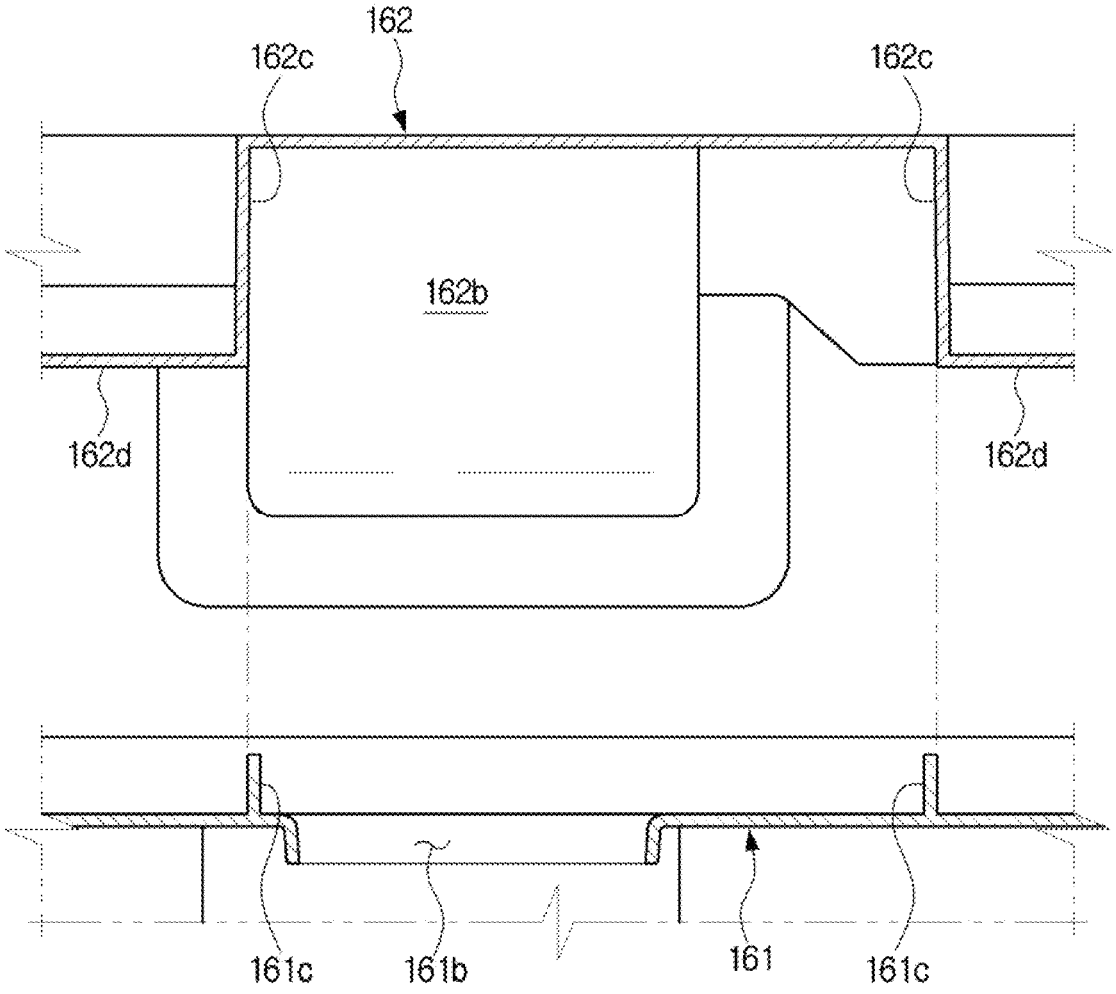
FIG. 8 is a partially enlarged view illustrating the coupling of the front panel and the front panel.

As mentioned above, since the sealing surface 161*c* is formed in a shape corresponding to the inner surface of the flow path forming protrusion 162*c*, when the front panel 161 and the front panel 162 are coupled to each other as illustrated in FIGS. 7 and 8, the sealing surface 161*c* is inserted into the flow path 162*b* as illustrated in FIG. 8, and thus the sealing surface 161*c* is in contact with the flow path forming protrusion 162*c* in the surface contact manner, as illustrated in a D part shown in FIG. 9.

It is difficult for the cold air to pass between the sealing surface 161*c* and the flow path forming protrusion 162*c*, which are in the surface contact state, and thus it may be possible to more reliably prevent the cold air passing the flow path 162*b* from leaking therethrough.

Through experiments, it was confirm that when the sealing surface 161*c* is formed in the front panel 161 as described above, it is required that a sum of the width W1 of the sealing surface 162*d* and the width W2 of the sealing surface 161*c* is 25 mm or more in order to reliably prevent leakage of cold air from the flow path 162*b*.

Since the sealing surface 161*c* supports the inner surface of the flow path forming protrusion 162*c* as described above, the sealing surface 161*c* serves to guide the flow path forming protrusion 162*c* to be installed at an accurate position and to prevent deformation of the flow path forming protrusion 162*c*.

As illustrated in FIG. 4, the fan assembly 163 includes a blowing fan 163*a* rotating to suck and to discharges air, a drive motor 163*b* generating a rotational force to rotate the blowing fan 163*a*, and a motor bracket 163*c* coupled to the drive motor 163*b* and then mounted to the mounting groove 161*a* to allow the fan assembly 163 to be fixed to the flow path 162*b* of the duct module 16.

In this embodiment, the blowing fan 163*a* is implemented by a centrifugal fan that sucks air in the axial direction and discharges the air radially outward, wherein the blowing fan 163*a* is disposed at a position corresponding to the above-described cold air inlet 162*a*.

In the above embodiment, the duct module 16 is applied to the freezing compartment 11 to distribute and supply the cold air to the freezing compartment 11, but it is merely an example. Alternatively, the duct module 16 may be applied to the refrigerating compartment 12 in the same manner.

In this embodiment, the flow path forming protrusions 162*c* protrude from the front surface of the front panel 162, and the sealing surface 162*d* is formed in parallel to the rear surface of the front panel 161 from the front end of the flow path forming protrusion 162*c*, but is not limited thereto. Alternatively, the flow path forming protrusions may protrude from the rear surface of the front panel, and the sealing surface may extend from the rear end of the flow path forming protrusion to be in parallel with the front surface of the front panel. Further, in this case, it is appropriate that the sealing surface protrudes from the front surface of the front panel to the front side.

In this embodiment, the front panel 161 includes the sealing surface 161*c*, but the sealing surface 161*c* is not essential. Therefore, it is possible to exclude the sealing surface 161*c*. In this case, through experiments, it was confirmed that the width of the sealing surface 162*d* is 25 mm or more to prevent the leakage of cold air through between the front surface of the sealing surface 162*d* and the rear surface of the front panel 161.

In this embodiment, the sealing surface 161*c* is formed to correspond to the entire portion of the flow path forming protrusion 162*c*, but is not limited thereto. Alternatively, the sealing surface 161*c* may be formed to correspond to a part of the flow path forming protrusion 162*c*. That is, since there may be a portion in which the sealing surface 162*d* does not have a sufficient width due to the shape of the flow path forming protrusion 162*c*, it may be possible to restrictively form the sealing surface 161*c* only in such a portion.

As is apparent from the above description, the refrigerator prevents the leakage of the cold air without interposing a separate sealing member, since the flow path forming protrusions are extended from any one of the rear surface of the front panel and the front surface of the front panel, and a sealing surface extended from the flow forming portions makes a surface contact with the other one of the rear surface of the front panel and the front surface of the front panel.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a storage compartment;

a cooling compartment configured to receive a evaporator;

a duct module positioned between the storage compartment and the cooling compartment to partition the storage compartment and the cooling compartment in a front and rear direction; and a blowing fan disposed in the duct module to suck air in the cooling compartment and discharge air to the storage compartment, wherein the duct module comprises:

a front panel; and a rear panel coupled to a rear side of the front panel by contacting continuously on three sides to form a flow path with the front panel, wherein the rear panel comprises:

a plurality of flow path forming protrusions configured to form a flow path by protruding from the rear panel to the front panel; and at least one sealing surface configured to be extended from the plurality of flow path forming protrusions to be parallel with the front panel, to make a surface contact with the front panel, wherein the front panel comprises at least one sealing protrusion protruding from the front panel toward the rear panel, to make a surface contact with the plurality of flow path forming protrusions, to form an area on the front panel, and the at least one sealing protrusion is formed in a shape corresponding to a shape of an inner surfaces of at least one of the plurality of flow path forming protrusions to support at least one of the plurality of flow path forming protrusions, wherein the at least one sealing surface protrudes toward an area on the front panel formed by the at least one sealing protrusion to fill the area on the front panel formed by the at least one sealing protrusion.

2. The refrigerator of claim 1, wherein the at least one sealing surface is extended to have a width, wherein the width of the at least one sealing surface is equal to or greater than 25 mm.

3. The refrigerator of claim 1, wherein the at least one sealing surface and the at least one sealing protrusion are extended to each have a width, wherein a sum of the width of one of the at least one sealing surface and the width of one of the at least one sealing protrusion is equal to or greater than 25 mm.

4. The refrigerator of claim 1, further comprising:

a plurality of locking hooks protruding from an end of any one of the front panel and the rear panel to an end of another of the front panel and the rear panel, and a plurality of locking grooves formed in a concave shape on an end of the other of the front panel and the rear panel, to be engaged with the plurality of locking hooks.

5. The refrigerator of claim 1, wherein:

the plurality of flow path forming protrusions comprises a pair of flow path forming protrusions disposed separated in a left and right side, and a single flow path forming protrusion provided to be inclined downward in a left and right direction between the pair of flow path forming protrusions; and the at least one sealing surface comprises a pair of sealing surfaces extended from the pair of the flow path forming protrusions to an outside, and a single sealing surface formed inside of the single flow path forming protrusion inclined downward in the left and right direction.

6. The refrigerator of claim 1, further comprising:

a body provided with the storage compartment and the cooling compartment partitioned in the front and rear direction by the duct module.

7. The refrigerator of claim 6, wherein the storage compartment comprises a refrigerating compartment and a freezing compartment provided in an upper portion and a lower portion of the body, and wherein the duct module is installed in at least one of the refrigerating compartment and the freezing compartment.

* * * * *